US009856603B2

(12) United States Patent
Anzel et al.

(10) Patent No.: US 9,856,603 B2
(45) Date of Patent: Jan. 2, 2018

(54) PROCESS FOR PRODUCTION OF A FIBROUS PULP WEB

(71) Applicant: Andritz AG, Graz (AT)

(72) Inventors: Andreas Anzel, Graz (AT); Klaus Gissing, Judendorf-Strassengel (AT); Thomas Scherb, Sao Paulo (BR); Wilhelm Mausser, Graz (AT)

(73) Assignee: ANDRITZ AG, Graz (AT)

( * ) Notice: Subject to any disclaimer, the term of this patent is extended or adjusted under 35 U.S.C. 154(b) by 0 days.

(21) Appl. No.: 15/283,636

(22) Filed: Oct. 3, 2016

(65) Prior Publication Data

US 2017/0096775 A1 Apr. 6, 2017

(30) Foreign Application Priority Data

Oct. 5, 2015 (AT) ..... A 50843/2015

(51) Int. Cl.
*D21F 5/18* (2006.01)
*D21F 1/76* (2006.01)

(52) U.S. Cl.
CPC . *D21F 1/76* (2013.01); *D21F 5/18* (2013.01)

(58) Field of Classification Search
CPC ..... D21F 5/18; D21F 1/76
See application file for complete search history.

(56) References Cited

U.S. PATENT DOCUMENTS 7,662,260 B2 2/2010 Thoroe-Scherb et al.

FOREIGN PATENT DOCUMENTS

EP 1 397 587 B1 2/2006

*Primary Examiner* — Mark Halpern
(74) *Attorney, Agent, or Firm* — Alix, Yale & Ristas, LLP

(57) ABSTRACT

A method for producing a fibrous pulp web, in which a fibrous pulp suspension is dewatered in a Twin Wire Former to form a fibrous pulp web which is dried with a TAD dryer. A pre-dewatering device with a hood and suction roll is provided after the Twin Wire Former and before the TAD dryer. The fibrous pulp web is guided through the pre-dewatering device between exactly two machine cloths. The machine cloth between suction roll and the web is a porous felt, and the machine cloth between web and hood is a structured wire. A volume flux of hot drying fluid greater than 100 $m^3/(m^2 \cdot min)$, preferably greater than 250 $m^3/(m^2 \cdot min,)$ is drawn through the fibrous pulp web into the suction roll.

20 Claims, 2 Drawing Sheets

PROCESS FOR PRODUCTION OF A FIBROUS PULP WEB

BACKGROUND

The present invention relates to a method for producing a fibrous pulp web, in particular a tissue or sanitary paper web.

Conventionally, a fibrous pulp suspension is dewatered in a Twin Wire Former in order to form a fibrous pulp web and then dried with the aid of a so-called through-air dryer (TAD). A pre-dewatering device with a hood and a suction roll is provided upstream of the TAD dryer. The fibrous pulp web is guided through the pre-dewatering device between exactly two machine cloths, and a hot fluid flows through the web, where the cloth between suction roll and fibrous pulp web is a felt and the cloth between fibrous pulp web and hood is a wire.

In conventional machines for the production of tissue with a TAD dryer, the fibrous pulp web is pre-dewatered first of all with the aid of vacuum to a dry content of approximately 25% and dried afterwards in the TAD dryer with large quantities of hot air. Here, air is heated by burners and conducted through the TAD hood with the aid of blowers and then through the fibrous pulp web into the TAD drum, where the water in the fibrous pulp web evaporates in this process. The differential pressure between the hood and the drum is low here. This through-air drying enables the production of particularly soft tissue.

However, the air permeability of the fibrous pulp web is a critical factor with TAD drums. If the fibrous pulp web is too damp, the hot air is unable to permeate through it. Thus, only impingement drying takes place in the first section of the TAD drum until the dry content of the fibrous pulp web is high enough for the air to pass through it. Only then is through-air drying possible. This undesirable impingement drying in the TAD dryer is a disadvantage for the moisture profile of the fibrous pulp web and, in addition, the drying efficiency drops and energy consumption increases. In order to achieve an adequate dry content, two TAD dryers are often arranged one after the other.

EP 1 397 587 B1 discloses a tissue machine that dispenses with the use of TAD dryers. Here the fibrous pulp web is pre-dried in a pre-dewatering device in which the fibrous pulp web is embedded between a wire and a felt, with hot air flowing through the fibrous pulp web at a temperature of <220° C., preferably <150° C., and an air volume flux of less than 50 $m^3/m^2 \cdot min$). Following this device, the fibrous pulp web is transferred to a Yankee dryer, where it undergoes final drying. A Yankee dryer operates according to the principle of impingement drying alone.

SUMMARY

According the present disclosure, the fibrous pulp web is guided on the suction roll only between a felt on the suction roll and a wire between the fibrous web and the hood. However, unlike EP 1 397 587 B1, the present invention enables much higher machine speeds and production capacities, as well as better paper quality—in terms of caliper, bulk, water absorption capacity, and softness.

The present disclosure is based on increasing the dry content in the fibrous pulp web so that the efficiency of the TAD drum is increased and energy consumption is reduced. In addition, the moisture profile of the fibrous pulp web across the machine direction should be more uniform compared to conventional TAD plants and preferably enable the use of only one TAD drum.

According to the present disclosure, the method uses a TAD drum and, in addition, a very high volume flux of fluid greater than 100 $m^3/(m^2 \cdot min)$, especially greater than 200 $m^3/(m^2 \cdot min)$, preferably greater than 250 $m^3/(m^2 \cdot min)$, is drawn through the fibrous pulp web by suction in the pre-dewatering device.

Pre-dewatering should be so gentle that the quality of the fibrous pulp web is not diminished as a result; pre-dewatering with presses or pressing belts can compress the fibrous pulp web excessively and thus have a negative impact on the quality.

The wire in the pre-dewatering device can be structured or non-structured. Even if the dewatering device is operated without a structured wire (e.g., embossing belt) the system is still able to produce a fibrous pulp web with a three-dimensional surface structure. The three-dimensional surface structure is created downstream, during the transfer to the TAD wire.

The differential pressure in the pre-dewatering device between the hood side and the suction roll side should be set to more than 0.25 bar, especially more than 0.45 bar, preferably more than 0.55 bar. As a result, the pre-dewatering device is operated at a differential pressure that is higher by some orders of magnitude than the differential pressure in the TAD drum, which is normally around 0.05 bar. This large differential pressure in the pre-dewatering device means that it is also possible to achieve through-air drying here, at least in certain zones.

The dryness before the TAD drum can be increased from approximately 25%, as obtained previously in conventional machines, to over 30%, especially to over 35%, preferably even to over 40%. In this way, the permeability of the fibrous pulp web increases, and through-air drying can take place in the TAD drum over the entire wrap zone.

The hot fluid can be hot air, for example, or hot steam. Favorable hot air temperatures are more than 150° C., especially more than 200° C., preferably more than 250° C.

The pre-dewatering device can also be sub-divided in machine direction into several zones, for example two zones. In this way, drying in the first zone can be conducted at other operating parameters, for example higher pressure, higher temperature, or with a different medium.

It is advantageous if the felt is a fine-pored material, where the average pore size of the felt surface facing the fibrous pulp web is smaller than the average pore size of the side facing the suction roll. If the top side of the felt facing the fibrous pulp web is fine and soft, this increases the contact area between the felt and the fibrous pulp web, which enhances capillary dewatering. On the other hand, a coarser felt surface towards the suction roll facilitates water drainage through the perforated suction roll surface to the inside of the roll. The fineness of the finer felt surface should be less than 6.7 dtex, preferably less than 3.3 dtex, and the layer directly beneath it should have a fineness of less than 17 dtex, preferably less than 11 dtex, whereas the opposite side facing the suction roll should then be much more open (coarser) to facilitate water drainage through the bore holes in the suction roll. These values relate to the basic fiber fraction in the felt.

In order to achieve the best possible contact between the felt and the fibrous pulp web in the pre-dewatering device, it is an advantage to provide a contact roll at the beginning of the pre-dewatering device that presses gently against the suction roll in such a way as to improve contact between the fibrous pulp web and the felt. However, the fibrous pulp web should not be pressed here or should only be pressed very lightly. Thus, the contact roll should only have a line force of less than 30 kN/m, where less than 15 kN/m would be better and less than 10 kN/m would be preferable.

In order to achieve the largest possible volume flux, the suction roll should have the largest possible free surface area, for example more than 25%, although more than 35% would be better.

It is an advantage if a Yankee dryer is provided after the TAD dryer.

BRIEF DESCRIPTION OF THE DRAWING

Two representative embodiments are described with reference to the Drawing, in which.

Identical reference numerals in the two figures refer to the same components in each case.

DETAILED DESCRIPTION

Figure 1:
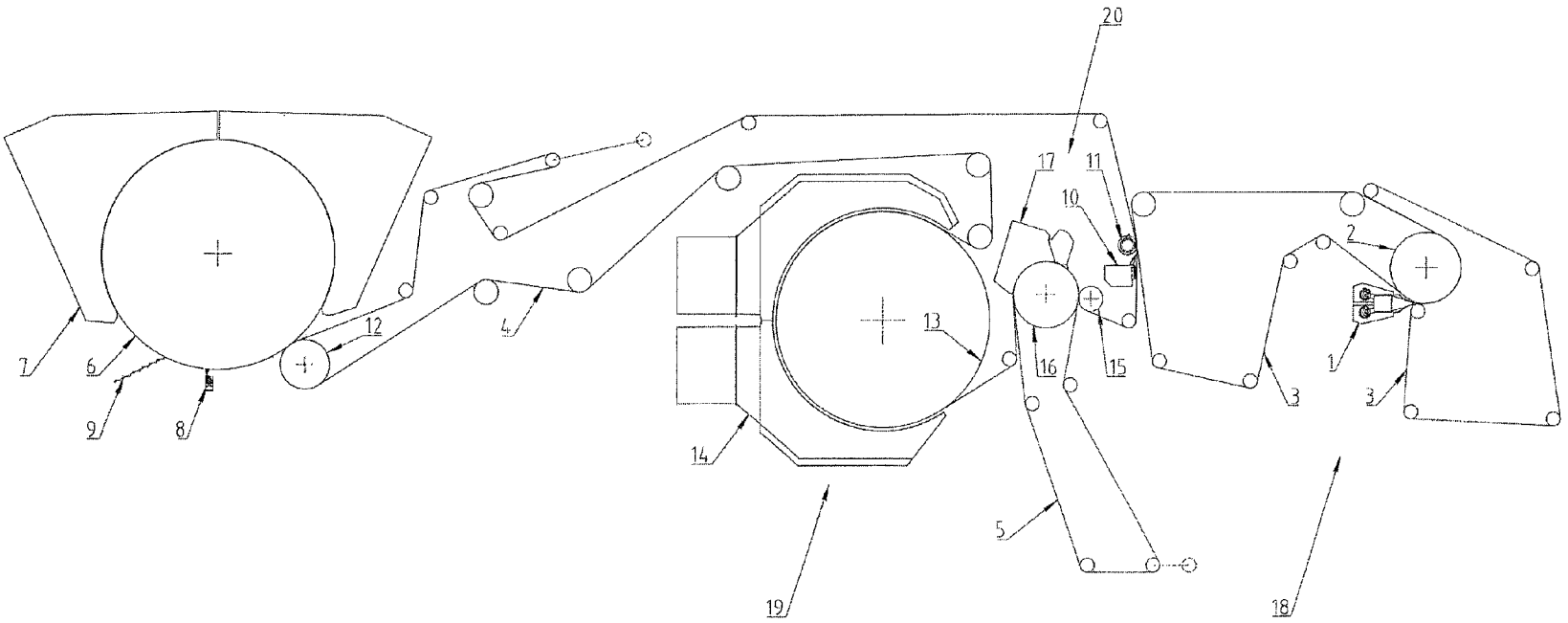
FIG. 1 shows a schematic (side) view of a tissue machine that is suitable for implementing the method according to the invention.

In FIG. 1, the pulp suspension is fed to a Twin Wire Former 18 through a headbox 1 between two forming wires 3, carried over a forming roll 2, and dewatered to a dry content of approximately 24% with the aid of vacuum boxes (not shown).

Subsequently, the fibrous pulp web 9 is transferred at the transfer box 11 to a structured TAD wire 4. The structured TAD wire 4 can (but does not have to) be moved a little more slowly than the wire 3 so that the fibers can fit well into the indentations in the TAD wire 4 (wet crepe); the suction box 10 for wet structuring sucks the fibers into the structure of the TAD wire 4.

Structured wires are known in this field of technology, and are sometime also called "moulding wires". This can be understood as wire having a multiplicity of surface recesses or indentations into which the fibrous web can be locally deformed.

After this, further dewatering takes place in the pre-dewatering device 20. The pre-dewatering device 20 has a hood 17, a felt 5, and a suction roll 16. The fibrous pulp web 9 attached to the TAD wire 4 can be pressed against the felt 5 and the suction roll 16 by the press roll (kiss press roll) 15. This improves contact between the felt 5 and the fibrous pulp web 9. The line force in this press nip is between 5 kN/m and 30 kN/m. At these pressures, only some 20% of the fibers are compacted, while the remaining 80% of the fibers are protected by the indentations in the TAD wire 4 and thus are not compressed.

The fibrous pulp web 9 is carried through the pre-dewatering device 20 between the felt 5 and the TAD wire 4. The felt 5 is on the surface of the suction roller 16 and the web 9 is on the felt 5, trapped beneath the overlying TAD wire 4. The felt 5 has a fine-pored cross section to enhance capillary dewatering. Unlike the structure on a moulding wire, the fine pores of the felt do not deform the web.

In a first zone, steam is blown onto the fibrous pulp web 9 through the hood 17 in an amount of more than 0.3 metric tons of steam per metric ton of fibrous pulp, where even more than 0.5 metric tons of steam per metric ton of fibrous pulp would be better, ideally even more than 1 metric ton of steam per metric ton of fibrous pulp.

In the subsequent, second zone, the moist, hot air at a temperature of more than 150° C., preferably more than 250° C., is blown through the fibrous pulp web. The moisture content of the hot air blown in through the hood 17 should preferably be more than 150 $g_{H2O}/kg_{air}$, especially more than 300 $g_{H2O}/kg_{air}$, preferably even more than 450 $g_{H2O}/kg_{air}$.

As the fibrous pulp web 9 is still very damp in the area of the pre-dewatering device 20, there is very little evaporation here. On the contrary, the heat supply reduces the viscosity of the water in the fibrous pulp web 9, which causes the water to be sucked out of the fibrous pulp web 9 through the suction roll 16. The fine-pored felt 5 enhances the dewatering process through capillary dewatering. The air volume added through the hood 17 is largely equal to the amount removed by suction through the suction roll 16. According to the invention, the air and steam volumes added are more than 100 $m^3/(m^2 \cdot min)$, especially more than 200 $m^3/(m^2 \cdot min)$, preferably even more than 250 $m^3/(m^2 \cdot min)$.

The pressure in the hood 17 is higher than the ambient pressure here so that none of the cold, ambient air is sucked in through the suction roll 16.

After the pre-dewatering device 20, the fibrous pulp web 9 with a dry content of more than 30%, especially more than 35% and preferably more than 40%, is transferred to the hot-air dryer 19. The hot-air dryer 19 is a TAD dryer, consisting of a TAD drum 13 and a TAD hood 14. With a dry content of 35% or more, there is no need for a second TAD drum.

Subsequently, the fibrous pulp web is transferred from the TAD wire 4 to a Yankee cylinder 6 by means of a press roll 12. On the Yankee cylinder 6, the fibrous pulp web 9 is dried further by the hot air applied through the hood 7 and then scraped off. The surface of the Yankee is sprayed with chemicals by a coating device 8 so that the fibrous pulp web can be scraped off the surface of the Yankee more easily.

Figure 2:
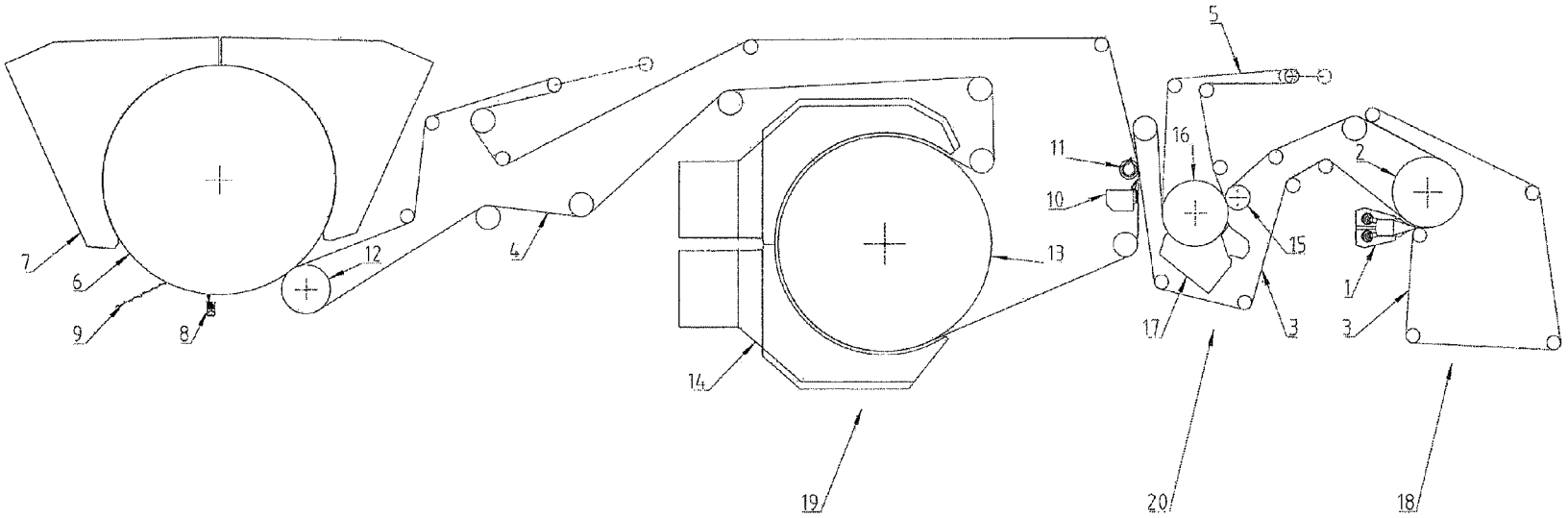
FIG. 2 shows schematic (side) view of another tissue machine according to the invention.

FIG. 2 illustrates another device for implementing the method according to the invention. In contrast to FIG. 1, the pre-dewatering device 20 is not arranged inside the structured TAD wire 4, but before this inside the wire 3 of the Twin Wire Former 18. The felt 5 is on the surface of the suction roller 16 and the web 9 is on the felt 5, trapped beneath the overlying forming wire 3.

The fibrous pulp web 9 is not transferred to the structured TAD wire 4 until after the pre-dewatering device 20. The wire 3 in the Twin Wire Former 18 can be a structured or a non-structured wire.

The invention claimed is:

1. The method for producing a fibrous pulp web, comprising:

dewatering a fibrous pulp suspension between forming wires in a Twin Wire Former to form a fibrous pulp web;

conveying the fibrous pulp web from the Twin Wire Former to a pre-dewatering device including a hood and suction roll where the fibrous pulp web is carried through the pre-dewatering device between the hood and the suction roll via guiding only between a felt on the suction roll and a wire between the fibrous web and the hood;

in the pre-dewatering device, drawing a volume flux of hot drying fluid greater than 100 $m^3/(m^2 \cdot min)$ through the fibrous pulp web into the suction roll; and following the pre-dewatering device, drying the fibrous pulp web in a hot-air dryer on a structured wire and through air dryer (TAD) drum.

2. The method according to claim 1, wherein the fibrous pulp web is guided through the pre-dewatering device with a structured wire.

3. The method according to claim 2, wherein the drying fluid includes hot air at a temperature greater than 150° C.;

a differential pressure in the pre-dewatering device between the hood and the suction roll is greater than 0.25 bar; and the flux of drying fluid through the fibrous pulp web is greater than 100 $m^3/(m^2 \cdot min)$.

4. The method according to claim 2, wherein the fibrous pulp web passes through first and second zones in succession in the pre-dewatering device, where the drying fluid is at a temperature greater than 200° C. and includes steam and hot air flowing through the fibrous pulp web in the first zone and only hot air flowing through the fibrous pulp web in the second zone; and a differential pressure in the pre-dewatering device between the hood and the suction roll is greater than 0.45 bar.

5. The method according to claim 1 wherein the fibrous pulp web formed on a forming wire of the Twin Wire Former is guided through the pre-dewatering device on said forming wire.

6. The method according to claim 5, wherein said forming wire that guides the fibrous pulp web is unstructured.

7. The method according to claim 1 wherein the drying fluid is hot air at a temperature greater than 150° C.

8. The method according to claim 7, wherein the drying fluid is moist hot air, with a moisture content greater than 150 $g_{H2O}/kg_{air}$.

9. The method according to claim 1, wherein the drying fluid is hot steam.

10. The method according to claim 1, wherein the fibrous pulp web passes through first and second zones in succession in the pre-dewatering device, where steam and hot air flow through the fibrous pulp web in the first zone and hot air flows through the fibrous pulp web in the second zone.

11. The method according to claim 1, wherein a differential pressure in the pre-dewatering device between the hood and the suction roll is greater than 0.25 bar.

12. The method according to claim 1, wherein the felt is a fine-pored material having through-pores between opposite exterior surfaces, with an average pore size of the felt surface facing the fibrous pulp web smaller than the average pore size of the felt surface facing the suction roll.

13. The method according to claim 1, wherein the fibrous pulp web is guided through the pre-dewatering device on the structured wire of the TAD drum.

14. The method according to claim 1, wherein the fibrous pulp web is fed to a Yankee after the TAD drum.

15. The method according to claim 1, wherein a contact roll confronts the suction roll to press the fibrous pulp web against the felt before the fibrous pulp web is guided between said felt and said wire.

16. The method according to claim 1, wherein the flux of drying fluid is greater than 200 $m^3/(m^2 \cdot min)$.

17. The method according to claim 1, wherein the drying fluid is at a temperature greater than 200° C.

18. The method according to claim 1, wherein the drying fluid includes moist hot air, with a moisture content greater than 150 $g_{H2O}/kg_{air}$.

19. The method according to claim 18, wherein the moist hot air has a moisture content greater than 300 $g_{H2O}/kg_{air}$.

20. The method according to claim 1, wherein a differential pressure in the pre-dewatering device between the hood and the suction roll is greater than 0.45 bar.

* * * * *